US010026350B2

(12) United States Patent
Jun et al.

(10) Patent No.: US 10,026,350 B2
(45) Date of Patent: Jul. 17, 2018

(54) DISPLAY DEVICE AND LUMINANCE CORRECTION METHOD OF THE SAME

(71) Applicant: SAMSUNG DISPLAY CO., LTD., Yongin-si, Gyeonggi-do (KR)

(72) Inventors: Byung Geun Jun, Yongin-si (KR); Min Cheol Kim, Yongin-si (KR); In Hwan Kim, Yongin-si (KR); Ui Yeong Cha, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 106 days.

(21) Appl. No.: 15/172,044

(22) Filed: Jun. 2, 2016

(65) Prior Publication Data

US 2017/0116904 A1 Apr. 27, 2017

(30) Foreign Application Priority Data

Oct. 22, 2015 (KR) ..... 10-2015-0147314

(51) Int. Cl.

| | |
|---|---|
| ***G09G 3/20*** | (2006.01) |
| ***G09G 3/3266*** | (2016.01) |
| ***G09G 3/3291*** | (2016.01) |
| ***G09G 3/3258*** | (2016.01) |
| ***G09G 3/36*** | (2006.01) |

(52) U.S. Cl.

CPC ..... *G09G 3/2007* (2013.01); *G09G 3/3258* (2013.01); *G09G 3/3266* (2013.01); *G09G 3/3291* (2013.01); *G09G 3/3677* (2013.01); *G09G 3/3688* (2013.01); *G09G 3/3696* (2013.01); *G09G 2310/0278* (2013.01); *G09G 2320/0233* (2013.01)

(58) Field of Classification Search

None

See application file for complete search history.

(56) References Cited

U.S. PATENT DOCUMENTS

| | | | | |
|---|---|---|---|---|
| 2006/0022917 | A1* | 2/2006 | Kim | G09G 3/30 345/83 |
| 2009/0135211 | A1 | 5/2009 | Wang et al. | |
| 2013/0169706 | A1* | 7/2013 | Harant | H04N 9/3111 345/697 |
| 2015/0116387 | A1 | 4/2015 | Jun et al. | |

* cited by examiner

*Primary Examiner* — Christopher Kohlman

(74) *Attorney, Agent, or Firm* — Lewis Roca Rothgerber Christie LLP

(57) ABSTRACT

A display device according to an exemplary embodiment of the present invention includes: a display unit configured to display a specific image according to first data supplied from the outside; an image compensator configured to receive a photographed image in which the specific image is photographed and generate variation information corresponding to luminance variations of pixels using the photographed image; an image corrector configured to generate second data by correcting the first data according to the variation information; and a data driver configured to generate a data signal using the first data or the second data and supply the data signal to the display unit.

15 Claims, 4 Drawing Sheets

DISPLAY DEVICE AND LUMINANCE CORRECTION METHOD OF THE SAME

CROSS-REFERENCE TO RELATED APPLICATION

This application claims priority to and the benefit of Korean Patent Application No. 10-2015-0147314, filed on Oct. 22, 2015 in the Korean Intellectual Property Office, the entire contents of which are incorporated herein by reference in their entirety.

BACKGROUND

1. Field

An exemplary embodiment according to of the present invention relates to a display device and a luminance correction method of the same.

2. Description of the Related Art

Recently, various kinds of display devices such as liquid crystal display (LCD) devices and organic light emitting diode (OLED) display devices have been widely used.

These display devices may include a display panel including pixels for emitting light, a data driver for providing data signals to the display panel, and a scan driver for providing scan signals to the display panel.

Each of the pixels receives a data signal from the data driver in response to a scan signal, and emits light with luminance corresponding to the data signal. However, a variation and/or the like of a manufacturing process may cause the pixels to have different characteristics and therefore luminance variations between the pixels may be generated. Accordingly, a display device capable of providing uniform luminance regardless of a luminance variation of pixels is desired.

SUMMARY

The embodiments of the present invention have been made in an effort to provide a display device capable of correcting luminance variations of pixels by correcting data using an image photographed by a photographing device, and a luminance correction method of the same.

A display device according to an exemplary embodiment of the present invention includes: a display unit configured to display a specific image according to first data supplied from the outside; an image compensator configured to receive a photographed image in which the specific image is photographed and to generate variation information corresponding to luminance variations of pixels using the photographed image; an image corrector configured to generate second data by correcting the first data according to the variation information; and a data driver configured to generate data signals using the first data or the second data and to supply the data signals to the display unit.

In some exemplary embodiments, the photographed image may be a black and white image.

In some exemplary embodiments, data signals having a same gray level may be provided to the pixels in the display unit when the specific image is displayed.

In some exemplary embodiments, the image compensator may include: a first image compensator configured to generate a first compensated image by compensating for a lens luminance variation associated with a characteristic of a lens for photographing the photographed image; a second image compensator configured to generate a second compensated image by compensating for a voltage drop variation of the data signal in the photographed image; and a third image compensator configured to generate the variation information by applying a gray level values of the specific image.

In some exemplary embodiments, the first image compensator may adjust luminance of at least one of a first region, which is a center part of the display unit, and an edge thereof, which is a second region.

In some exemplary embodiments, the first image compensator may compensate for the lens luminance variation by increasing luminance of the second region.

In some exemplary embodiments, the first image compensator generates the first compensated image with the lens luminance variation compensated from the photographed image using the following equation:

$$P_{comp1}=-[\sqrt{r_1^2-(n_x-L)}+\sqrt{r_1^2-(n_y-L)}]+2r_1$$

where the $P_{comp1}$ may represent a first luminance value generated by compensating a luminance value of each of the pixels for displaying the photographed image, the $r_1$ may represent a radius of a hemisphere of a first mask, $n_x$ may represent x-axis positions of the pixels arranged along a first direction in the display unit, $n_y$ may represent y-axis positions of the pixels arranged along a second direction perpendicular to the first direction in the display unit, L may represent a total number of pixels, and the first mask may represent the radius of the hemisphere that corresponds to a distribution of a first luminance parameter to be applied to the luminance value of each of the pixels.

In some exemplary embodiments, the second image compensator may compensate for the voltage drop variation by adjusting luminance of the pixels close to the data driver.

In some exemplary embodiments, the second image compensator may compensate for the voltage drop variation by decreasing the luminance of the pixels close to the data driver.

In some exemplary embodiments, the second image compensator generates the second compensated image with the voltage drop variation compensated using the following equation:

$$P_{comp2}=-[\sqrt{r_2^2-(n_x-L)}+\sqrt{r_2^2-(n_y-L)}]+2r_2$$

where the $P_{comp2}$ may represent a second luminance value generated by compensating a luminance value of each of the pixels for displaying the photographed image, the $r_2$ may represent a radius of a hemisphere of a second mask, $n_x$ may represent x-axis positions of the pixels arranged along a first direction in the display unit, $n_y$ may represent y-axis positions of the pixels arranged along a second direction perpendicular to the first direction in the display unit, L may represent a total number of pixels, and the second mask may represent the radius of the hemisphere formed by a distribution of a second luminance parameter to be applied to the luminance value of each of the pixels.

In some exemplary embodiments, the third image compensator may apply a luminance compensation ratio to a second luminance value of the second compensated image according to the gray level values of the specific image.

In some exemplary embodiments, the third image compensator may calculate the luminance compensation ratio using the following equation:

$$\text{weight}=1-[(1-Pm)\times(I.\text{Gray})/255]$$

where the weight may be the luminance compensation ratio, the Pm may be a luminance parameter of the second luminance values calculated by dividing a minimum luminance value by a reference luminance value, and I.Gray may represent a gray level value of the specific image.

In some exemplary embodiments, the third image compensator generates the variation information including a third luminance value using the following equation:

$$O.P = \text{weight} \times I.P$$

where the O.P may be the third luminance value of each of the pixels, and the I.P may represent the second luminance value.

A luminance correction method of a display device according to another exemplary embodiment of the present invention includes: displaying a specific image according to first data supplied from the outside; receiving a photographed image in which the specific image is photographed; generating variation information according to a luminance variation of the photographed image; and generating second data by compensating the first data according to the variation information.

In some exemplary embodiments, generating the variation information may include: compensating for a lens luminance variation associated with a characteristic of a lens of the photographing device for photographing the photographed image; compensating for a voltage drop variation of a data signal included in the photographed image; and generating the variation information by applying a gray level value of the specific image.

In some exemplary embodiments, compensating for the lens luminance variation may adjust luminance of at least one of a center part of the photographed image, which is a first region, and a second region other than the first region.

In some exemplary embodiments, compensating for the voltage drop variation may adjust luminance of a part of the photographed image adjacent to the data driver for supplying the data signal.

According to the display device according to the current exemplary embodiment of the present invention and the luminance correction method of the same, an image photographed by the photographing device can be used to generate variation information of the pixels, and the variation information can be used to uniformly configure characteristics of the pixels. In addition, in the present invention, the variation information can be generated in consideration of characteristics of a voltage drop of the data signal as well as the lens used in the photographing device, thereby ensuring reliability of compensation.

DETAILED DESCRIPTION

Figure 1:
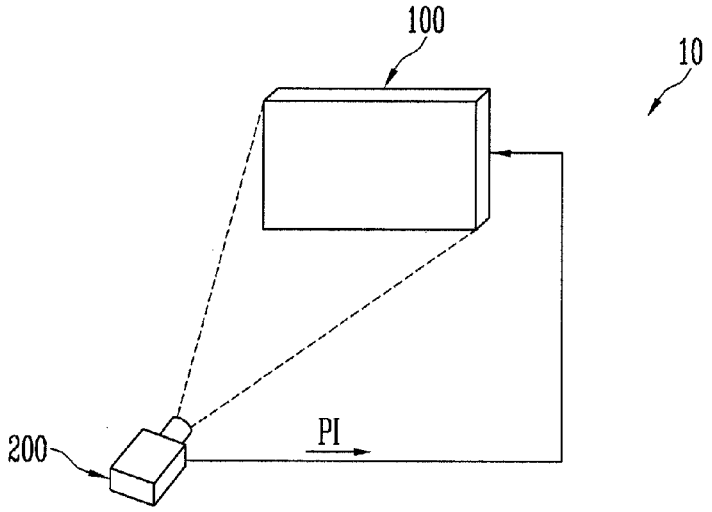
FIG. 1 is a conceptual diagram of a luminance correction system according to an exemplary embodiment of the present invention.

A specific structural or functional description for exemplary embodiments according to the concept of the present invention disclosed in the present specification is exemplarily made to describe the exemplary embodiments according to the concept of the present invention, and the exemplary embodiments according to the concept of the present invention may be practiced in various forms without being limited to the exemplary embodiments described in the present specification.

Because the exemplary embodiments according to the concept of the present invention may have various modifications and various forms, the exemplary embodiments will be illustrated in the drawings and be fully described in the present specification. However, it is to be understood that the exemplary embodiments according to the concept of the present invention are not limited to the specific forms of this disclosure but include all modifications, equivalents, and substitutions included in the spirit and scope of the present invention.

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section, without departing from the spirit and scope of the present invention.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Furthermore, "connection," "connected," etc., may also refer to "electrical connection," "electrically connected," etc., depending on the context in which such terms are used as would be understood by those skilled in the art. When an element or layer is referred to as being "directly on," "directly connected to," "directly coupled to," "directly connected with," "directly coupled with," or "immediately adjacent to" another element or layer, there are no intervening elements or layers present.

Other expressions illustrating the relationship between the components, that is, "between" and "directly between" or "adjacent to" and "directly adjacent to," should also be similarly interpreted.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

Unless otherwise defined in the present disclosure, all suitable terms used herein, including technical or scientific terms, have the same or substantially the same meanings as meanings which are generally understood by those skilled in the technical field to which the embodiments of the present invention pertain. Terms defined in a generally used dictionary shall be construed as having meanings matching those in the context of a related art, and shall not be construed as having ideal or excessively formal meanings unless they are clearly so defined in the present specification.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

As used herein, "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

A relevant device or component (or relevant devices or components), for example an image compensator, an image corrector, and/or a timing controller, according to embodiments of the present invention described herein may be implemented utilizing any suitable hardware, firmware (e.g. an application-specific integrated circuit), software, or a suitable combination of software, firmware, and hardware. For example, the various components of the relevant device (s) may be formed on one integrated circuit (IC) chip or on separate IC chips. Further, the various components of the relevant device(s) may be implemented on a flexible printed circuit film, a tape carrier package (TCP), a printed circuit board (PCB), or formed on a same substrate as one or more circuits and/or other devices. Further, the various components of the relevant device(s) may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

An image described by exemplary embodiments of the present invention may mean an image displayed by one pixel or images collectively displayed by a plurality of pixels.

Hereinafter, exemplary embodiments of the present invention will be described in detail with reference to the drawings attached to the present specification.

FIG. 1 is a conceptual diagram of a luminance correction system according to an exemplary embodiment of the present invention.

Referring to FIG. 1, the luminance correction system 10 according to an exemplary embodiment of the present invention includes a photographing device 200 and a display device 100.

The photographing device 200 may generate a photographed image PI by photographing a specific image displayed on the display device 100.

In some exemplary embodiments, the photographing device 200 may be implemented as a black and white camera. For example, the photographing device 200 may photograph the image displayed on the display device 100 and generate the photographed image PI that is implemented as a black and white image.

The photographing device 200 may transmit the photographed image PI to the display device 100.

The specific image displayed on the display device 100 may correspond to any one selected from displayable gray level values (e.g., gray levels 0 to 225). In addition, when having one gray level, the specific image may include only a specific color.

For example, the specific image displayed on the display device 100 may be any one selected from a red image of 255 gray level, a green image of 255 gray level, a blue image of 255 gray level, and a white image of 255 gray level.

The display device 100 may use the photographed image PI received from the photographing device 200 to generate an image with a corrected luminance variation.

Figure 2:
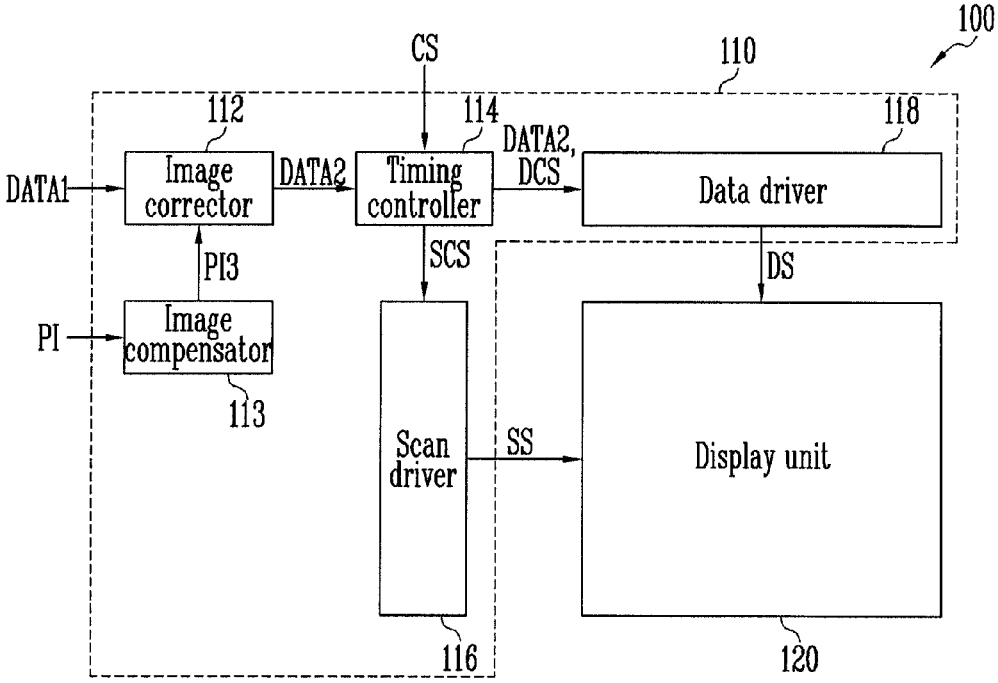
FIG. 2 is a schematic block diagram of a display device illustrated in FIG. 1.

FIG. 2 is a schematic block diagram of a display device illustrated in FIG. 1.

Referring to FIGS. 1 and 2, the display device 100 according to the current exemplary embodiment of the present invention may include a display driver 110 and a display unit 120 (e.g., a display device).

The display driver 110 may provide a data signal DS and a scan signal SS for displaying the image to the display unit 120.

The display driver 110 may include an image compensator 113, an image corrector 112, a timing controller 114, a scan driver 116, and a data driver 118.

In the exemplary embodiment illustrated in FIG. 2, the image corrector 112 and the image compensator 113 are described as being integrated into the display driver 110, but in some exemplary embodiments, at least one of the image corrector 112 and the image compensator 113 may be implemented as a separate device outside of the display device 100.

In addition, according to another exemplary embodiment, the image corrector 112 may be integrated into the timing controller 114.

The image compensator 113 may generate variation information PI3 based on the photographed image PI that is received from the photographing device 200. The image compensator 113 may provide the variation information PI3 to the image corrector 112. A method of generating the variation information PI3 based on the photographed image PI via the image compensator 113 will be described in detail with reference to FIG. 3.

The image corrector 112 may analyze the variation information PI3, correct first data Data1 (provided from an external system) according to the analyzed result, and generate second data Data2. Here, the second data Data2 is configured according to the variation information PI3 such that the image with uniform luminance is displayed on the display unit 120.

Specifically, the variation information PI3 may include a luminance value to be changed that is generated by comparing luminance of each of the pixels with a reference luminance. The image corrector 112 may use the luminance value to be changed included in the variation information PI3 to generate the second data Data2 that is corrected from the first data Data1.

The second data Data2, which is generated by applying the luminance value to be changed, is configured to compensate for the luminance variation between the pixels. In this case, the second data Data2 allows the image displayed on the display unit 120 to have uniform luminance (e.g., an image in which a stain is removed).

The image corrector 112 may transmit the second data Data2 to the timing controller 114.

The timing controller 114 may use the control signal CS received from the external system to generate a scan control signal SCS and a data control signal DCS.

The timing controller 114 may transmit the scan control signal SCS to the scan driver 116.

The timing controller 114 may transmit the data control signal DCS to the data driver 118. In addition, the timing controller 114 may rearrange the second data Data2 such that it can be displayed on the display unit 120, and may transmit the rearranged second data Data2 to the data driver 118.

The scan driver 116 may transmit the scan signal SS to scan lines in response to the scan control signal SCS.

The data driver 118 may use the second data Data2 and the data control signal DCS to generate the data signal DS, and may transmit the generated data signal DS to data lines.

The display unit 120 may include pixels that are connected to the scan lines and the data lines in order to display the image.

For example, the display unit 120 may be implemented as an organic light emitting display panel, a liquid crystal display panel, a plasma display panel, or the like, but it is not limited thereto.

The pixels are selected in a horizontal line unit when the scan signal SS is provided to the scan lines. The pixels selected by the scan signal SS may receive the data signal DS from the data lines that are connected to the pixels. After receiving the data signal DS, the pixels emit light with a luminance according to the data signal DS.

On the other hand, the data signal DS is generated by the second data Data2 in which the luminance value to be changed is reflected, and the pixels may accordingly emit light with uniform luminance.

Figure 3:
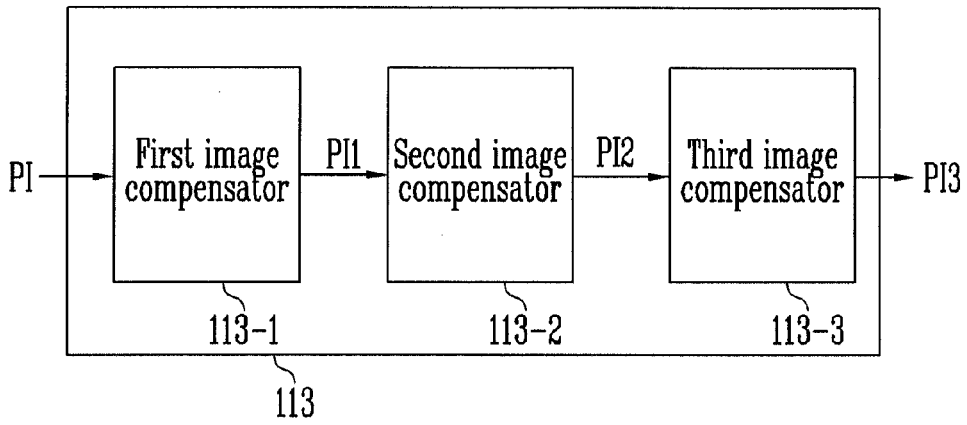
FIG. 3 is a schematic block diagram of an image compensator illustrated in FIG. 2.

FIG. 3 is a schematic block diagram of an image compensator illustrated in FIG. 2.

Referring to FIGS. 2 and 3, the image compensator 113 may include a first image compensator 113-1, a second image compensator 113-2, and a third image compensator 113-3.

The first image compensator 113-1 may compensate for the luminance variation associated with a characteristic of the lens that is generated when the photographing device 200 photographs the specific image displayed on the display device 100.

The first image compensator 113-1 may generate a first compensated image by compensating the luminance variation of the photographed image PI that is associated with the characteristic of the lens 210. A method of generating the first compensated image PI1 based on the photographed image PI via the first image compensator 113-1 will be described below in detail with reference to FIGS. 4 and 5.

The second image compensator 113-2 may compensate for a voltage drop variation of the data signals DS based on the photographed image PI.

In some exemplary embodiments, the second image compensator 113-2 may generate a second compensated image PI2 by compensating for a voltage drop variation of the data signals DS based on the first compensated image PI1.

Specifically, the second image compensator 113-2 may generate the second compensated image PI2 by compensating for the voltage drop variation of the data signal DS generated according to positions of the data driver 118 and the pixels based on the first compensated image PI1.

For example, some pixels sharing one data line that are positioned close to the data driver 118 may receive the data signal DS that has a smaller amount of voltage drop than the other pixels positioned farther away from the data driver 118.

When the display device 100 adjusts the data signal DS based on the pixels positioned farther away from the data driver 118, the pixels positioned close to the data driver 118 receive the data signal DS that is overcompensated. Accordingly, due to the overcompensated data signal DS, a luminance variation may also be generated in the pixels that are positioned close to the data driver 118.

In order to compensate for the overcompensated luminance due to the data signal DS, the second image compensator 113-2 may generate the second compensated image PI2 by adjusting luminance of the first compensated image PI1. A method of generating the second compensated image PI2 based on the first compensated image PI1 via the second image compensator 113-2 will be described below in detail with reference to FIGS. 6 and 7.

The third image compensator 113-3 may generate the variation information PI3 associated with the gray level value of the specific image that is displayed by the display device 100. That is, the third image compensator 113-3 may generate the variation information PI3 associated with the specific image based on the second compensated image PI2. Here, the second compensated image PI2 corresponds to the specific image that is displayed by implementing the same or substantially the same gray level in all of the pixels.

In some exemplary embodiments, the third image compensator 113-3 may compare luminance of each of the pixels included in the second compensated image PI2 with a reference luminance. In this case, due to a characteristic variation, each of the pixels may have a different luminance for the same or substantially the same gray level. The third image compensator 113-3 compares luminance of each of the pixels with the reference luminance, and may generate the variation information PI3 including the luminance value to be changed according to the comparison result. Here, when the data signal with the same or substantially the same gray level is supplied to the pixels, the luminance value to be changed may be configured to generate light with the same or substantially the same luminance regardless of the characteristic of each of the pixels.

According to another exemplary embodiment, the image corrector 112 may compare luminance of each of the pixels included in the variation information PI3 with the reference luminance. According to the comparison result, the image corrector 112 may generate the second data Data2 based on the first data Data1.

In addition, in some exemplary embodiments, a degree of the voltage drop variation may be higher when the specific image has a high gray level than when it has a low gray level.

For example, an amount of voltage drop generated when the display device 100 displays a specific image having a low gray level may be smaller than an amount of voltage drop generated when displaying a specific image having a high gray level. As the voltage drop generated in the pixels positioned farther away from the data driver 118 increases, the luminance variation generated in the pixels positioned close to the data driver 118 may excessively increase.

Accordingly, the third image compensator 113-3 may compensate for the luminance (i.e., luminance value to be changed) differently according to each gray level of the specific image because a voltage drop variation for each gray level value of the specific image is different.

Specifically, the third image compensator 113-3 may apply a gray level compensation ratio to a second luminance value of the second compensated image PI2 according to the gray level of the specific image.

In some exemplary embodiments, the third image compensator 113-3 may compensate for the luminance for each gray level according to the following Equation 1 and Equation 2.

$$\text{weight}=1-[(1-Pm)\times(I.\text{Gray})/255] \quad \text{Equation 1}$$

Here, the weight is a luminance compensation ratio, the $P_m$ is a luminance parameter, and the I.Gray is a gray level value of the specific image.

The gray level parameter $P_m$ is a value calculated by dividing a minimum luminance value of the luminance values which are included in the second compensated image PI2 by the reference luminance value.

In addition, I.Gray represents the gray level value of the specific image. For example, when the display device displays a 200 gray level image, the gray level value of the specific image (I.Gray) has a value of 200.

$$O.P=\text{weight}\times I.P \quad \text{Equation 2}$$

Here, O.P is a third luminance value of each of the pixels included in the variation information PI3, and I.P is a second luminance value of each of the pixels.

The third image compensator 113-3 may generate the variation information PI3 by calculating the third luminance value of each of the pixels (O.P). The third image compensator 113-3 may provide the variation information PI3 to the image corrector 112.

In some exemplary embodiments, the third image compensator 113-3 may compare the third luminance value (O.P) with the reference luminance. The third image compensator 113-3 may generate the variation information PI3 including the luminance value to be changed according to the comparison result.

According to another exemplary embodiment, the image corrector 112 may compare the third luminance value (O.P) included in the variation information PI3 with the reference luminance. According to the comparison result, the image corrector 112 may generate the second data Data2 based on the first data Data1.

In summary, the first image compensator 113-1 according to the current exemplary embodiment of the present invention may compensate for the luminance variation of the lens for photographing the photographed image PI to generate the first compensated image PI1, the second image compensator 113-2 may compensate for the voltage drop variation of the data signal DS based on the first compensated image PI1 to generate the second compensated image PI2, and the third image compensator 113-3 may generate the variation information PI3 based on the second compensated image PI2.

Figure 4:
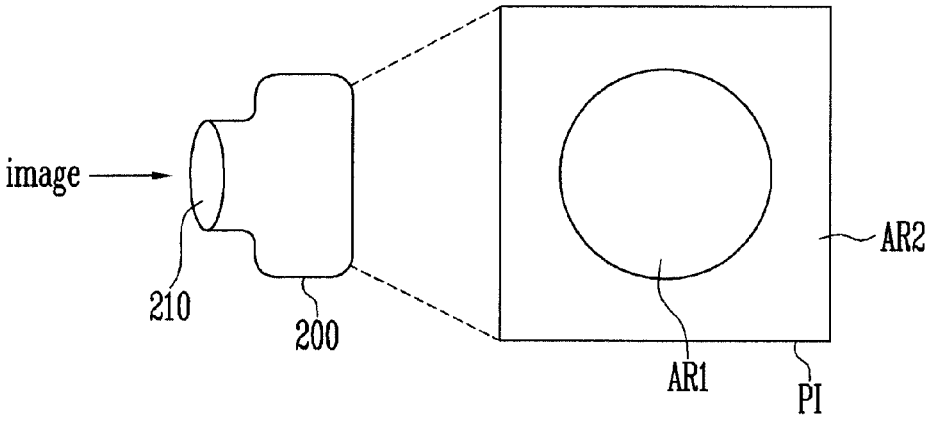
FIG. 4 is a conceptual diagram of a photographed image that was photographed by a photographing device according to the exemplary embodiment of the present invention.
Figure 5:
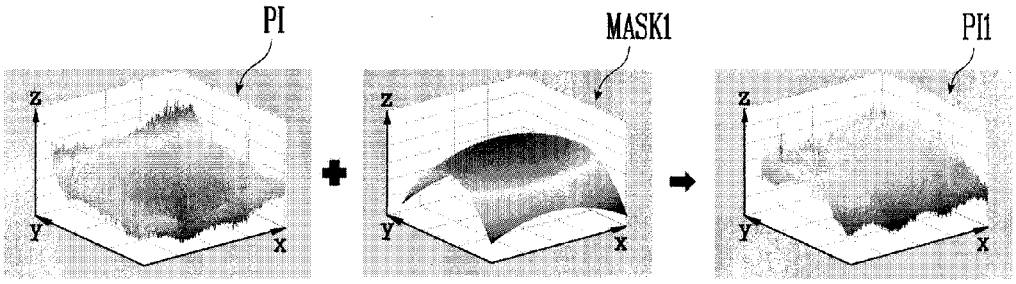
FIG. 5 is a conceptual diagram illustrating a method of generating a first compensated image based on the photographed image via a first image compensator according to the exemplary embodiment of the present invention.

FIG. 4 is a conceptual diagram of a photographed image that was photographed by a photographing device according to the exemplary embodiment of the present invention, and FIG. 5 is a conceptual diagram illustrating a method of generating a first compensated image based on the photographed image via a first image compensator according to the exemplary embodiment of the present invention.

Referring to FIG. 4, the photographing device 200 may photograph an image that is received via the lens 210. Because the lens 210 has a circular shape, light incident on the photographing device 200 may not be generally uniform.

For example, an amount of light incident on an edge of the lens 210 of the photographing device 200 may be smaller than an amount of light incident on a center part of the lens 210. Accordingly, regardless of the specific image displayed on the display unit 120, a first region AR1 of the center part of the photographed image PI may have higher luminance than a second region AR2 of the edge thereof.

For ease of description, it is described that the center part of the photographed image PI is set to be the first region AR1, the edge thereof is set to be the second region AR2, and the luminance of the first region AR1 appears to be higher than the luminance of the second region AR2, but this luminance variation may be caused by the characteristics of the lens 210.

FIG. 5 illustrates the photographed image, a first mask, and the first compensated image.

In FIG. 5, an x-axis represents positions of the pixels arranged along a first direction (e.g., horizontal direction), and a y-axis represents positions of the pixels arranged along a second direction perpendicular to the first direction.

Accordingly, when the display unit 120 is viewed on a plane, the position of each of the pixels may be represented by an x-axis coordinate and a y-axis coordinate.

In addition, z-axes of the photographed image PI and the first compensated image PI1 represent a luminance value of the image displayed by each of the pixels, and a z-axis of the first mask MASK1 represents a first gray level parameter to be applied to each of the pixels.

The first image compensator 113-1 may compensate for the luminance variation according to the characteristic of the lens 210 by adjusting at least one of the luminances of the first region AR1 and the luminances of the second region AR2.

For example, the first image compensator 113-1 may compensate for the luminance variation associated with the characteristic of the lens 210 by increasing the luminance of the second region AR2.

Specifically, the first image compensator 113-1 may compensate for the luminance associated with the characteristic of the lens 210 by adjusting the luminance value of the photographed image PI.

The first image compensator 113-1 may generate the first compensated image PI1 by applying the first mask MASK1 to the photographed image PI. That is, the first image compensator 113-1 may generate a compensated luminance value by applying a first luminance parameter corresponding to the luminance value of the image displayed by each of the pixels included in the photographed image PI.

The first mask MASK1 according to the current exemplary embodiment of the present invention is generated by analyzing a luminance distribution associated with the characteristic of the lens 210. The distribution of the first gray level parameter for each pixel having a hemisphere shape is illustrated, in one exemplary embodiment, by analyzing the photographed image PI illustrated in FIG. 4, but it is not limited thereto, and the distribution of the first gray level parameter may be variously modified and practiced.

The first image compensator 113-1 may generate the compensated first luminance value of each pixel for the photographed image PI using Equation 3.

$$P_{comp1}=-[\sqrt{r_1^2-(n_x-L)}+\sqrt{r_1^2-(n_y-L)}]+2r_1 \quad \text{Equation 3}$$

Here, $P_{comp1}$ represents the compensated first luminance value of each of the pixels, $r_1$ represents a radius of a hemisphere of the first mask, $n_x$ represents an x-axis position of the pixel, $n_y$ represents a y-axis position of the pixel, and L represents a total number of pixels.

The first image compensator 113-1 may calculate the first luminance value $P_{comp1}$ by applying the equation above to the luminance value of each of the pixels included in the photographed image, and may use the first luminance values $P_{comp1}$ to generate the first compensated image PI1 with the variation of the lens 210 compensated.

Accordingly, the first image compensator 113-1 may compensate for the luminance variation associated with the characteristic of the lens 210.

Figure 6:
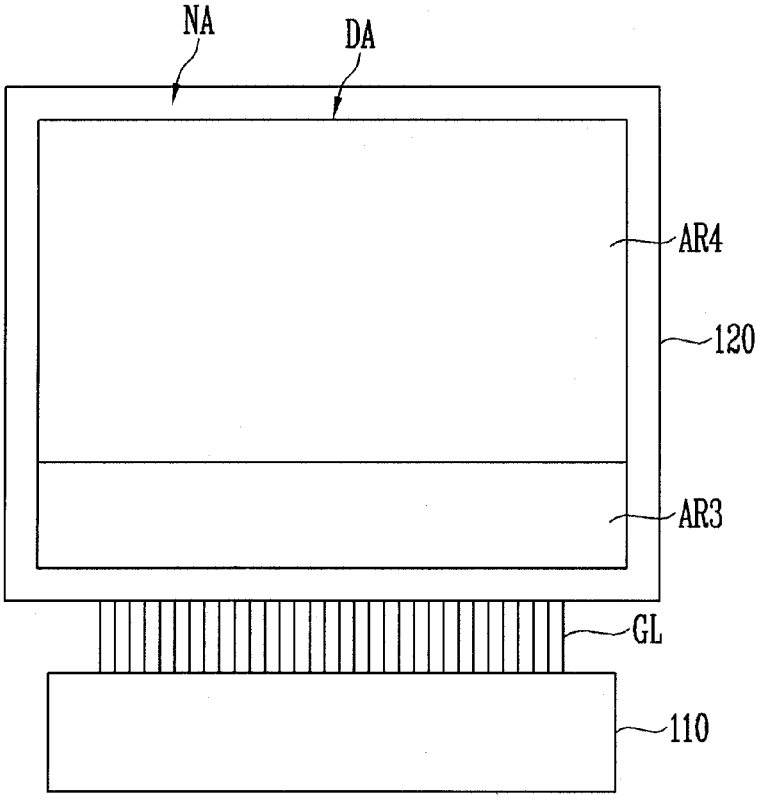
FIG. 6 is a conceptual diagram of a connection relationship between the display device and a display driver according to the exemplary embodiment of the present invention.
Figure 7:
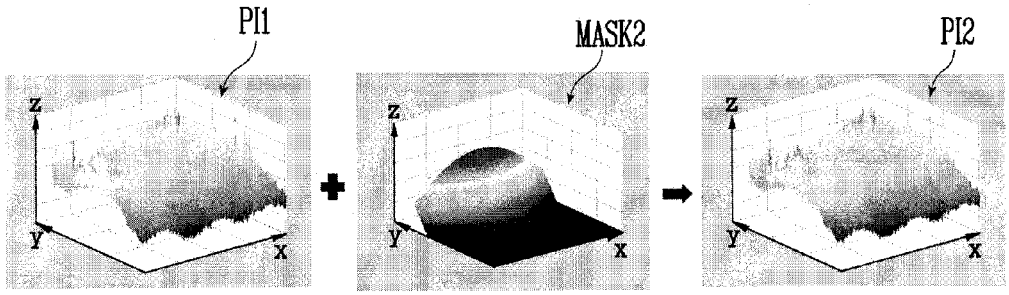
FIG. 7 is a conceptual diagram illustrating a method of generating a second compensated image based on the first compensated image via a second image compensator according to the exemplary embodiment of the present invention.

FIG. 6 is a conceptual diagram of a connection relationship between the display device and a display driver according to the exemplary embodiment of the present invention, and FIG. 7 is a conceptual diagram illustrating a method of generating a second compensated image based on the first compensated image via a second image compensator according to the exemplary embodiment of the present invention.

Referring to FIG. 6, for ease of description of the present invention, it is illustrated that the pixels disposed close to the display driver 110 are positioned in the third region AR3 while the pixels disposed farther away from the display driver 110 are positioned in a fourth region AR4, but it is not limited thereto.

The display unit 120 may be connected to the display driver 110 via a plurality of signal lines GL.

For example, the plurality of signal lines GL may include data lines, scan lines, and power supply lines.

The display unit 120 may be divided into a display area DA in which an image is displayed, and a non-display area NA in which an image is not displayed. The plurality of pixels is positioned in the display area DA, and may be connected to the data lines, the scan lines, and the power supply lines.

Each of the pixels of the display unit 120 may receive power from a power supply, or may emit light with luminance corresponding to the data signal DS provided from the data driver 118. In this case, a voltage corresponding to the data signal DS provided to the display unit 120 is provided to each of the pixels via the data lines.

However, a voltage drop may be generated due to resistance components of the data lines. In this case, due to the voltage drop generated in the data lines, the data signal provided to the pixels of the fourth region AR4 may be smaller than the data signal provided to the pixels of the third region AR3.

Referring to FIG. 7, gray level value distributions of the first compensated image PI1 and the second compensated image PI2 for each pixel, and a second mask MASK2 to be applied to the first compensated image PI1 are illustrated.

Here, an x-axis represents positions of the pixels arranged along a first direction (e.g., horizontal direction), and a y-axis represents positions of the pixels arranged along a second direction perpendicular to the first direction.

Accordingly, when the display unit 120 is viewed on a plane, the position of each of the pixels may be represented by an x-axis coordinate and a y-axis coordinate.

In addition, z-axes of the first compensated image PI1 and the second compensated image PI2 represent a luminance value of the image displayed by each of the pixels, and a z-axis of the second mask MASK2 represents a second luminance parameter to be applied to each of the pixels.

The second image compensator 113-2 may compensate for a voltage drop variation of the data signal DS by adjusting luminance of the pixels disposed close to the data driver 118.

Specifically, the second image compensator 113-2 may compensate for luminance associated with a connection relationship between the display unit 120 and the display driver 110 by adjusting the luminance values of the first compensated image PI1.

The second image compensator 113-2 may generate the second compensated image PI2 by applying the second mask MASK2 to the first compensated image PI1. That is, the second image compensator 113-2 may generate the second luminance values by applying the second luminance parameter to the first compensated image PI1.

The second mask MASK2 according to the current exemplary embodiment of the present invention is generated by analyzing a luminance distribution of the overcompensated pixels according to the connection relationship between the display unit 120 and the display driver 110. The distribution of the second luminance parameter for each pixel having a hemisphere shape is illustrated only as one exemplary embodiment by analyzing a degree of compensation of the data signals of the display driver illustrated in FIG. 6, and it is not limited thereto, so the distribution of the second luminance parameter may be variously modified and practiced.

The second image compensator 113-2 may generate the compensated second luminance value of each pixel for the first compensated image using Equation 4.

$$P_{comp2}=-[\sqrt{r_2^2-(n_x-L)}+\sqrt{r_2^2-(n_y-L)}]+2r_2 \quad \text{Equation 4}$$

Here, $P_{comp2}$ represents a compensated second luminance value of each of the pixels, $r_2$ represents a radius of a hemisphere of the second mask MASK2, $n_x$ represents an x-axis position of each of the pixels, $n_y$ represents a y-axis position of each of the pixels, and L represents a total number of pixels.

The second image compensator 113-2 may calculate the second luminance value $P_{comp2}$ by applying the equation above to the first luminance value of each of the pixels included in the first compensated image PI1, and may generate the second compensated image PI2 including the second luminance value $P_{comp2}$.

Figure 8:
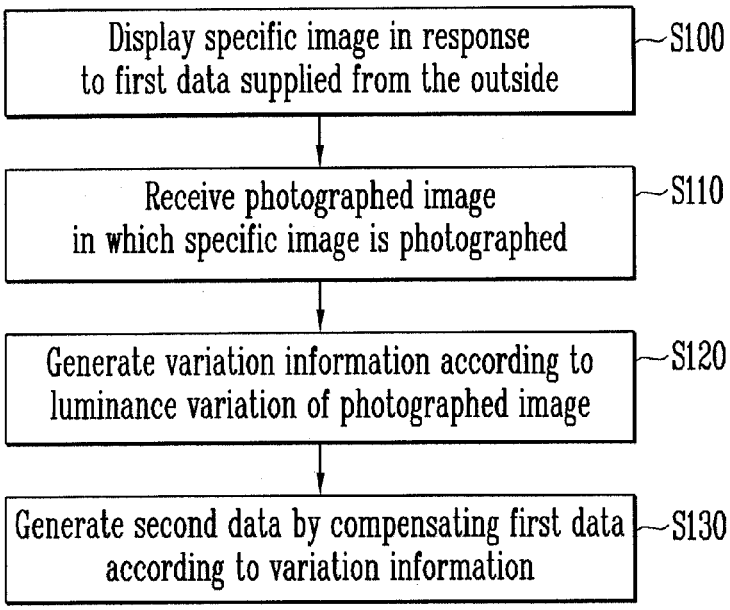
FIG. 8 is a flowchart illustrating a luminance correction method of the display device according to the exemplary embodiment of the present invention.

FIG. 8 is a flowchart illustrating a luminance correction method of the display device according to the exemplary embodiment of the present invention.

Referring to FIG. 8, a display unit 120 may display a specific image in response to first data supplied from the outside (S100).

An image compensator 113 may receive a photographed image in which the specific image is photographed (S110).

The image compensator 113 may generate variation information PI3 according to a luminance variation of the photographed image PI (S120).

The image corrector 112 may generate second data (e.g., corrected data DATA2) by compensating the first data (e.g., original data DATA1) according to the variation information PI3 (S130).

While embodiments of the present invention have been described with reference to the exemplary embodiment illustrated in the drawings, this is only illustrative, so those of ordinary skill in the art will appreciate that various suitable modifications and equivalent other embodiments are possible therefrom. Therefore, the true technical scope of the present invention should be defined by the technical spirit of the appended claims and their equivalents.

What is claimed is:

1. A display device comprising:

a display unit configured to display a specific image according to first data supplied from the outside;

an image compensator configured to receive a photographed image in which the specific image is photographed and to generate variation information corresponding to luminance variations of pixels using the photographed image;

an image corrector configured to generate second data by correcting the first data according to the variation information; and a data driver configured to generate data signals using the first data or the second data and to supply the data signals to the display unit, wherein the image compensator comprises:

a first image compensator configured to generate a first compensated image by compensating for a lens luminance variation associated with a characteristic of a lens for photographing the photographed image;

a second image compensator configured to generate a second compensated image by compensating for a voltage drop variation of the data signal in the photographed image; and a third image compensator configured to generate the variation information by applying a gray level values of the specific image.

2. The display device of claim 1, wherein the photographed image comprises:

a black and white image.

3. The display device of claim 1, wherein the data signals comprising a same gray level are provided to the pixels in the display unit when the specific image is displayed.

4. The display device of claim 1, wherein the first image compensator is configured to adjust luminance of at least one of a first region, which comprises a center part of the display unit, and a second region, which comprises an edge part of the display unit.

5. The display device of claim 4, wherein the first image compensator is configured to compensate for the lens luminance variation by increasing luminance of the second region.

6. The display device of claim 4, wherein the first image compensator is configured to generate the first compensated image, with the lens luminance variation compensated, from the photographed image using the following equation:

$$P_{comp1}=-[\sqrt{r_1^2-(n_x-L)}+\sqrt{r_1^2-(n_y-L)}]+2r_1$$

where the $P_{comp1}$ represents a first luminance value generated by compensating a luminance value of each of the pixels for displaying the photographed image, the $r_1$ represents a radius of a hemisphere of a first mask, $n_x$ represents x-axis positions of the pixels arranged along a first direction in the display unit, $n_y$ represents y-axis positions of the pixels arranged along a second direction perpendicular to the first direction in the display unit, and L represents a total number of pixels, and wherein the first mask comprises the radius of the hemisphere that corresponds to a distribution of a first luminance parameter to be applied to the luminance value of each of the pixels.

7. The display device of claim 1, wherein the second image compensator is configured to compensate for the voltage drop variation by adjusting luminance of the pixels close to the data driver.

8. The display device of claim 7, wherein the second image compensator is configured to compensate for the voltage drop variation by decreasing the luminance of the pixels close to the data driver.

9. The display device of claim 7, wherein the second image compensator is configured to generate the second compensated image with the voltage drop variation compensated using the following equation:

$$P_{comp2}=-[\sqrt{r_2^2-(n_x-L)}+\sqrt{r_2^2-(n_y-L)}]+2r_2$$

where the $P_{comp2}$ represents a second luminance value generated by compensating a luminance value of each of the pixels for displaying the photographed image, the $r_2$ represents a radius of a hemisphere of a second mask, $n_x$ represents x-axis positions of the pixels arranged along a first direction in the display unit, $n_y$ represents y-axis positions of the pixels arranged along a second direction perpendicular to the first direction in the display unit, and L represents a total number of pixels, and wherein the second mask comprises the radius of the hemisphere formed by a distribution of a second luminance parameter to be applied to the luminance value of each of the pixels.

10. The display device of claim 1, wherein the third image compensator is configured to apply a luminance compensation ratio to a second luminance value of the second compensated image according to the gray level values of the specific image.

11. The display device of claim 10, wherein the third image compensator is configured to calculate the luminance compensation ratio using the following equation:

$$\text{weight}=1-[(1-Pm)\times(I.\text{Gray})/255]$$

where the weight is the luminance compensation ratio, the Pm is a luminance parameter of the second luminance value calculated by dividing a minimum luminance value by a reference luminance value, and I.Gray is a gray level value of the specific image.

12. The display device of claim 11, wherein the third image compensator is configured to generate the variation information comprising a third luminance value using the following equation:

$$O.P=\text{weight}\times I.P$$

where the O.P comprises the third luminance value of each of the pixels, and the I.P comprises the second luminance value.

13. A luminance correction method of a display device comprising:

displaying a specific image according to first data supplied from the outside;

receiving a photographed image in which the specific image is photographed;

generating variation information according to a luminance variation of the photographed image; and generating second data by compensating the first data according to the variation information, wherein the generating the variation information comprises:

compensating for a lens luminance variation associated with a characteristic of a lens of a photographing device for photographing the photographed image;

compensating for a voltage drop variation of a data signal comprised in the photographed image; and generating the variation information by applying a gray level value of the specific image.

14. The method of claim 13, wherein the compensating for the lens luminance variation comprises:

adjusting luminance of at least one of a center part of the photographed image, which comprises a first region, and a second region other than the first region.

15. The method of claim 13, wherein the compensating for the voltage drop variation comprises:

adjusting luminance of a part of the photographed image adjacent to a data driver for supplying the data signal.

* * * * *